United States Patent [19]

Norman

[11] Patent Number: 4,878,619

[45] Date of Patent: Nov. 7, 1989

[54] FLUID SPRAY SYSTEM HAVING A REPLACEABLE CARTRIDGE

[75] Inventor: Richard O. Norman, San Antonio, Tex.

[73] Assignee: Environmental Delivery Systems, Inc., San Antonio, Tex.

[21] Appl. No.: 265,526

[22] Filed: Nov. 1, 1988

[51] Int. Cl.[4] ..... B05B 7/30

[52] U.S. Cl. ..... 239/318; 239/335; 239/417.5; 239/427.5; 239/428.5

[58] Field of Search ..... 239/309, 310, 318, 335, 239/119, 272, 428.5, 427.3, 427.5, 417.5

[56] References Cited

U.S. PATENT DOCUMENTS

| | | | |
|---|---|---|---|
| 2,153,240 | 4/1939 | Dailey | 239/310 |
| 2,310,633 | 2/1943 | Heimburger | 239/428.5 |
| 2,811,390 | 10/1957 | Kiraly | 239/309 |
| 3,186,643 | 6/1965 | George et al. | 239/318 |
| 3,204,875 | 9/1965 | Langstroth | 239/310 |
| 3,658,091 | 4/1972 | Buzzi | 239/335 |
| 4,527,740 | 7/1985 | Gunzel, Jr. et al. | 239/318 |
| 4,767,058 | 8/1988 | La Rosa et al. | 239/318 |

FOREIGN PATENT DOCUMENTS

| | | | |
|---|---|---|---|
| 2449852 | 9/1975 | Fed. Rep. of Germany | 239/310 |
| 2517220 | 6/1983 | France | 239/272 |

*Primary Examiner*—Andres Kashnikow
*Assistant Examiner*—Michael J. Forman
*Attorney, Agent, or Firm*—Thomas E. Sisson

[57] ABSTRACT

A fluid spraying system having a spray gun capable of alternatively selecting a low pressure aerated cleaning or high pressure non-aerated rinsing mode. The system further has an interchangeable and disposable fluid cartridge with a combination metering and check valve. The cartridge is sealingly engagable with the gun by use of a bellows fitment. The system utilizes the principle of increased or decreased flow volume to alternatively draw fluid from the cartridge or bypass the cartridge.

11 Claims, 2 Drawing Sheets

FLUID SPRAY SYSTEM HAVING A REPLACEABLE CARTRIDGE

BACKGROUND OF THE INVENTION

This invention relates to a pressure fluid spray system, specifically to a hand-held spray gun having an interchangeable and disposable cleaning fluid cartridge wherein the gun has a selector valve for alternatively drawing fluid from the cartridge.

There are many spray gun configurations known in the art. The present invention is designed to meet the needs of users who are required to provide for rapid cleaning and rinsing operations without the use of skilled operators. In operations where the cleaning solutions must be accurately formulated because of the high cost and/or high toxicity of the base solution, the present invention provides accurate metering of highly concentrated cleansers or disinfectants. Since the operator is not involved in the metering operation, human errors are largely eliminated. Further, since the metering valve is disposed with the disposable cartridge, accuracy of the amount of fluid delivered for mixing is assured because a new valve is provided more frequently.

Another significant advantage of the present invention is that the system provides a spray gun with the capability of alternating between a low pressure (aerated wide spray) cleaning mode and a high pressure (non-aerated narrow spray) rinse mode, without requiring complex operations by the user. A simple operation of the unique selector valving of the present invention allows for a rapid and safe changeover from one mode to another. The user is not required to handle any highly concentrated and/or highly toxic base solution in order to make the switch from cleaning to rinsing.

SUMMARY OF THE INVENTION

The present invention is a system which combines an interchangeable and disposable cartridge having its own metering and check valve combination, as well as a bellows-like sealing fitment for engagement with the spraying valve arrangement. Each time the cartridge is replaced the system uses a new metering valve insuring accuracy of fluid delivered to the gun and a fresh, resilient bellows fitment for sealing engagement with the gun.

The spray gun of the present system offers a unique selector valve which enables the user to alternatively draw fluid from the cartridge or bypass the cartridge without requiring the cartridge to be physically removed from engagement with the gun. The system uses the principle of expansion of the volume through which a fluid passes to regulate whether fluid is drawn from the cartridge, as well as providing necessary aeration for the effective mixing and foaming of fluids discharged from the gun nozzle in the cleaning mode.

DETAILED DESCRIPTION OF THE PREFERRED EMBODIMENT

Figure 1:
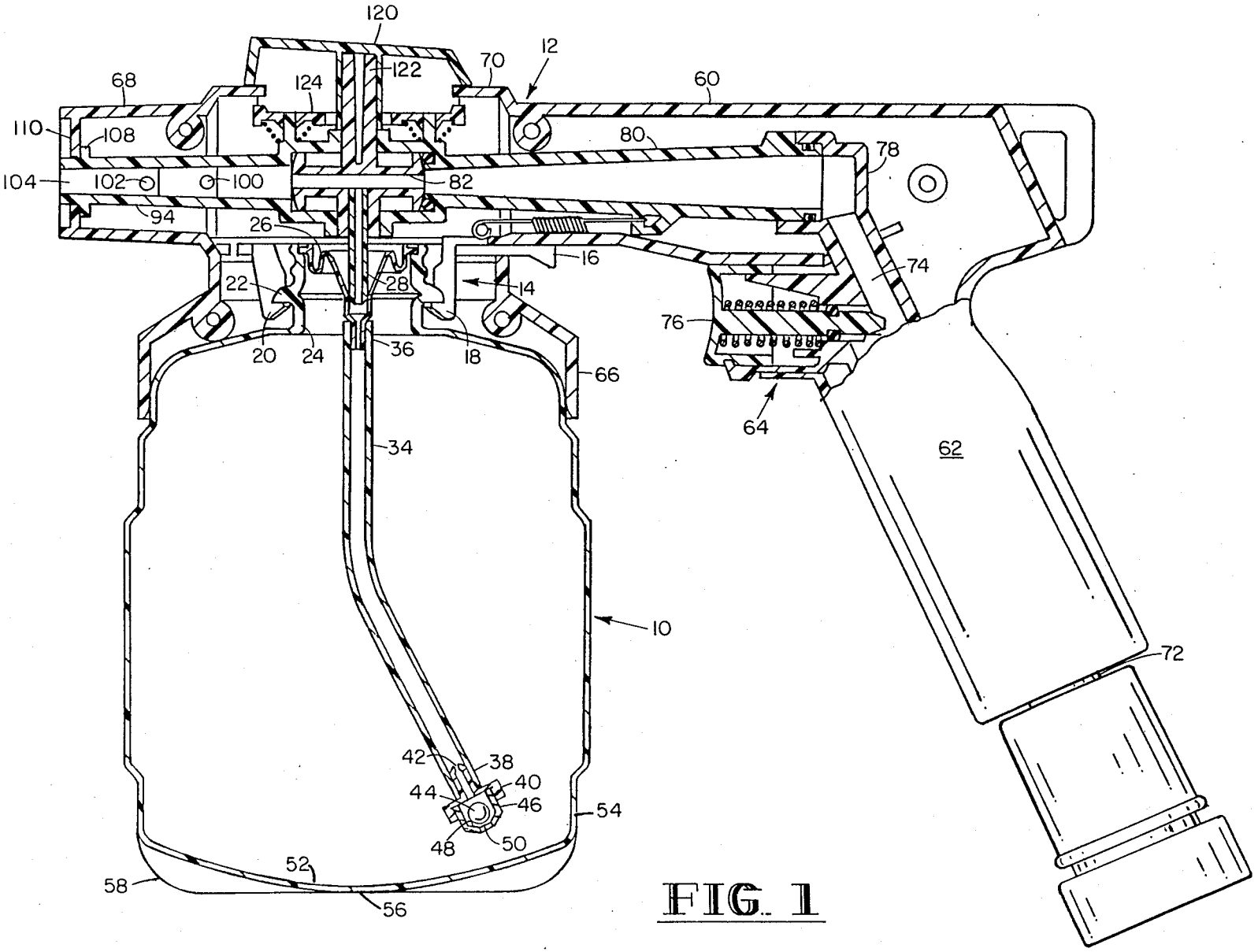
FIG. 1 illustrates a sectional view of the system of the present invention.

FIG. 1 illustrates a sectional view of the present invention. An interchangeable and disposable, plastic, fluid cartridge 10 is releasably attached to gun 12 by release mechanism 14. Mechanism 14 incorporates a spring loaded release switch 16 which cooperates with latching tabs 18 and 20 to engage latching flange 22 on neck 24 of cartridge 10 to secure cartridge 10 to gun 12.

Figure 2A:
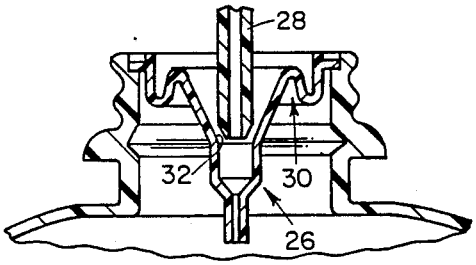
FIG. 2A illustrates a sectional view of the fitment of the present invention in its relaxed position.
Figure 2B:
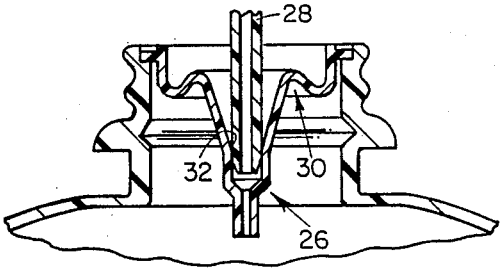
FIG. 2B illustrates a sectional view of the fitment of the present invention in its tensioned and sealing position.

Cartridge 10 has fitted inside of neck 24 a bellow-like soft flexible fitment 26. FIGS. 2A and 2B illustrate fitment 26 in greater detail. As will be discussed further gun 12 has a valve cylinder pin 28 which not only functions as a conduit to draw fluid from cartridge 10, but also functions to pierce fitment 26 forming a force fit seal. FIG. 2A shows fitment 26 in its relaxed condition prior to engagement or piercing by pin 28. FIG. 2B shows the engagement of pin 28 with fitment 26 whereby the z-shaped bellows 30 has been flexed and is in a tensioned position. Pin 26 has been seated against the inner wall 32 of fitment 26 with the tensioned bellows 30 urging sealing of inner wall 32 against pin 28. Thus without the addition of complex sealing mechanisms, a positive, fluid-tight seal is produced between gun 12 (via pin 28) and cartridge 10.

Extending downwardly from the bottom portion of fitment 26 is pickup tube 34. Tube 34 is attached to fitment 26 at an upper end 36 and extends inside of cartridge 10 functioning as a conduit to transport fluid from cartridge 10 to gun 12. On the lower end 38 of tube 34 is attached a combination metering and check valve 40. Orifice 42 in valve 40 is sized to deliver to gun 12 through tube 34 a measured amount of fluid from cartridge 10 when gun 12 is operating in its cleaning or foaming mode as will be described later. Depending upon the particular fluid in cartridge 10, orifice 42 is appropriately sized to ensure the proper concentration of fluid will be mixed in gun 12 prior to discharge to the environment. When gun 12 is operating in its rinse mode, valve 40 operates as a check valve wherein ball 44 in cage section 46 of valve 40 is forced into sealing engagement with the inside seal 48 of orifice 50.

It should be noted that cartridge 10 has a concave inner surface 52 on bottom 54 so that there are no cavities or pockets for collection of fluid and tube 34 has a length such that it allows valve 40 to extend to the nadir 56 of concave inner surface 52. Thus cartridge 10 is structured to ensure a complete emptying prior to disposal. Cartridge 10 has base support member 58 which provides a flat external surface on which cartridge 10 may rest without tipping over.

Although not shown in the figures, cartridge 10 has a storage cap which is removably secured by any conventional means to neck 24 during storage of cartridge 10.

Because cartridge 10 is intended to be disposed of after it is emptied, each time a replacement cartridge is attached to gun 12, the system is supplied with a new metering valve. This ensures not only accurate formulation of the mixed solution, but also eliminates the likelihood of valve plugging so common in the prior art. Further, with each new cartridge, the system is provided with a new fitment 26. Again, this ensures a fresh, resilient seal for engagement with cylinder pin 28.

FIG. 1 shows that gun 12 has an outer housing 60 which incorporates a handle section 62, a trigger section 64, a cartridge shroud 66 which includes latching mechanism 14, a nozzle section 68, and a selector switch portion 70.

Handle portion 62 further includes an input fluid adaptor 72 for connection to an external fluid source such as a water line. Extending inside and through handle 62 is a handle input conduit 74. Cooperating with trigger section 64 is a tension activated trigger mechanism 76 which selectively engages and disengages a seal plunger (not shown) for allowing input fluid to flow through conduit 74. At the upper end 78 of conduit 74 is attached selector input conduit 80 which directs input fluid toward selector valve 82. Valve 82 is rotatably and sealingly secured within gun 12 in selector switch portion 70 of housing 60.

Figure 3:
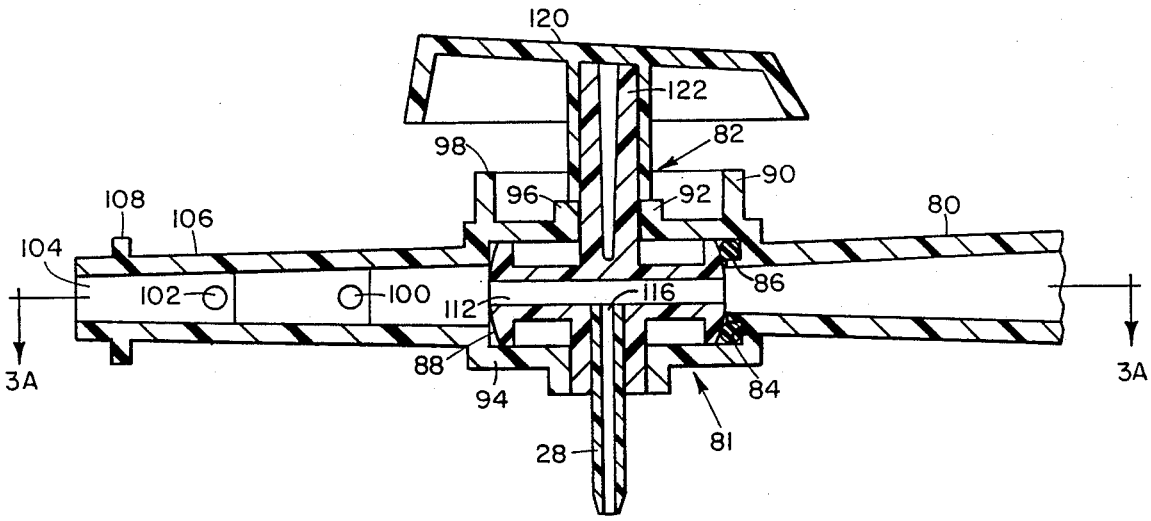
FIG. 3 illustrates a sectional view of the flow path of the present invention through the selector valve.

As can be seen in FIG. 3, conduit 80 has on its selector end 81 closest to valve 82 a seal groove 84 for retaining valve seal 86 in sealing engagement with outer sliding surface 88 of valve 82. Further, conduit 80 has vertically extending first detent post 90 and valve neck support shoulder 92. FIG. 3 further illustrates that valve 82 is partially housed for proper alignment within selector end 81 of conduit 80.

Cooperating with conduit 80 for partially housing valve 82 is nozzled conduit 94. As with conduit 80, nozzle conduit 94 has a valve neck support shoulder 96 and a vertically extending second detent post 98. Disposed along the intermediate portion of conduit 94 are aeration ports 100 and 102 which allow air to pass into conduit 94 and mix with and aerate fluid passing through conduit 94 on its way to nozzle discharge orifice 104 when valve 82 is positioned for the cleaning mode. Circumferentially around the discharge end 106 of conduit 94 is a nozzle stop flange 108 which abuts against nozzle stop shoulder 110.

Figure 3A:
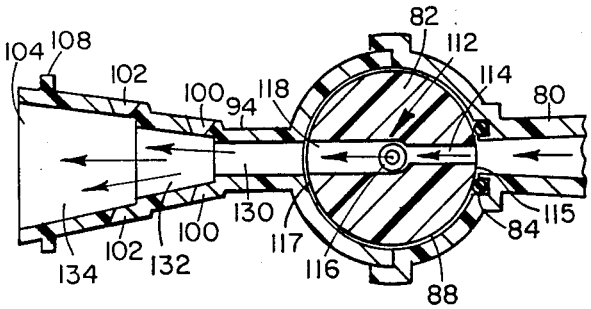
FIG. 3A illustrates a sectional view of the flow path of the present invention in the cleaning mode.

FIG. 3A illustrates a sectional view taken along line 3A—3A of FIG. 3 and shows flow path from conduit 80, through flow channel 112 of valve 82, through nozzle conduit 94 and eventually out nozzle orifice 104.

A first portion of channel 112 is a narrow portion 114. Narrow portion 114 extends from a first side 115 of outer sliding surface 88 to the middle of valve 82 immediately above valve inlet orifice 116. A second portion of channel 112 is a wide portion 118. Wide portion 118 extends from the middle of valve 82 immediately above valve inlet orifice 116 to a second side 117 of outer sliding surface 88. By selectively rotating valve 82, either narrow portion 114 or wide portion 118 may be aligned with conduit 80 to receive fluid from the external fluid source. FIG. 3A illustrates the narrow portion aligned with conduit 80. Rotation of valve 82 is achieved by turning selector valve switch knob 120 which is attached to valve neck 122. Valve 82 is maintained in the selected position by use of a conventional detent system including spring loaded detent plate 124 which engages detent posts 90 and 98. (See FIG. 1, detent not shown in FIG. 3.)

Valve 82, as shown in FIG. 3A, is in the cleaning or foaming mode. In this mode fluid (water) flows through conduit 80 from an external source. As the water passes through narrow portion 114 of flow channel 112, the water pressure is at a first pressure. As the water passes over inlet port 116, the water experiences a decrease in pressure because it encounters wide portion 118 of channel 112. This decrease in pressure creates a vacuum in inlet port 116, thereby drawing cleaning fluid from cartridge 10 through valve 40, tube 34, and valve cylinder pin 28. Since valve 40 is a metering valve only a small amount of cleaner is drawn during the operation of the system.

Once the fluid from cartridge 10 is mixed with the external fluid from conduit 80 in wide portion 118 of channel 118, the mixed fluid enters nozzle conduit 94.

FIG. 3A further shows that nozzle conduit 94 has three sections 130, 132, and 134. Each successive section is wider than the preceding section, section 130 being the narrowest and 134 being the widest. At the leading portion of section 132, on both sides, are disposed aeration ports 100. As the mixed fluid passes from section 130 to section 132, the volume of the flow path is increased and the pressure appropriately decreased. Again, because of the decrease in pressure, air is drawn through port 100 improving the fluid mixing and aerating the mixture. A decrease in flow pressure is also experienced. A second, increased aeration occurs as the fluid then passes into section 134 because aeration ports 102 are disposed on both sides of the leading portion of wider nozzle conduit section 134. As one can see, fluid being discharged from nozzle orifice 104 is now thoroughly mixed, aerated and at a lower pressure. With the proper selection and quantities of fluids from cartridge 10, the present system provides a means for discharging various concentrations of foams in a wide spray of relatively low pressure.

Figure 3B:
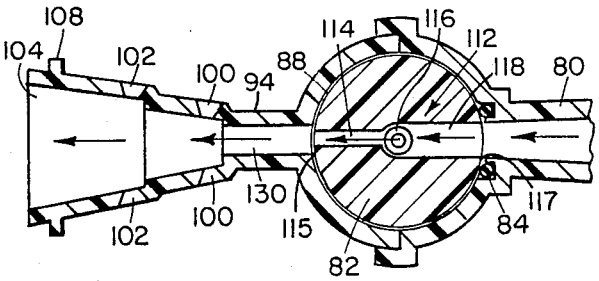
FIG. 3B illustrates a sectional view of the flow path of the present invention in a rinsing mode.

After the user has completed a foaming operation, selector switch 120 is rotated as shown in FIG. 3B. In this alternative position, fluid passing out of conduit 80 experiences no appreciable pressure change as it passes into wide portion 118, since portion 118 is essentially the same width as the discharge opening in conduit 80. However, as the fluid passes over inlet port 116, it encounters narrow portion 114, and the fluid pressure is increased. A portion of the fluid will now be forced down through cylinder pin 28, tube 34, and into valve 40. Since valve 40 may function as a check valve, ball 44 is forced into sealing engagement, in cage section 46, with inside seal 48 to close and seal orifice 50. Thus in the alternative mode shown in FIG. 3B, no fluid is drawn from cartridge 10.

As the external fluid passes out of narrow portion 114 into nozzle conduit 94, it is exposed to sections 130, 132, and 134, however, since the fluid flow out of narrow portion 114 now has a higher pressure, narrow spray pattern, and there are no aeration ports in section 130, aerating of the fluid prior to discharge from nozzle orifice 104 does not occur. From the foregoing description, it will be appreciated that where the external fluid is water, operation in the alternative mode results in a high pressure rinse cycle with the system.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A fluid spraying system comprising:

a spray gun further comprising:

a first fluid input conduit;

a selector valve having a flow channel in fluid communication with said first fluid conduit, said valve having a second fluid inlet port in fluid communication with said flow channel;

a second fluid discharge conduit for discharging a first discharge from said selector valve flow channel, said flow channel positionable to alternatively draw from said inlet port or partially discharge to said inlet port;

a means for activating flow of a first fluid through said first fluid input conduit; and a means for discharging to the environment a discharge from said second fluid discharge conduit; and an interchangeable and disposable cartridge sealingly engageable with said spray gun, said cartridge further comprising:

a housing for containment of a second fluid within said cartridge;

a means for sealing engagement with said second fluid inlet port , a means for delivery of a metered amount of said second fluid to said selector valve.

2. The invention of claim 1 wherein said cartridge further comprises:

a means for ensuring substantially a complete emptying of said second fluid from said cartridge.

3. The invention of claim 2 wherein said means for sealing engagement of said cartridge with said selector valve is a bellows fitment.

4. The invention of claim 3 wherein said second fluid inlet port in said selector valve is generally perpendicular to said flow channel.

5. The invention of claim 4 wherein said means for discharging to said environment further mixes and aerates said discharge from said second fluid discharge conduit when said selector valve is positioned to draw from said inlet port, said means for discharging to said environment not aerating said discharge from said second fluid discharge conduit when said selector valve is positioned to partial discharge to said inlet port.

6. The invention of claim 5 wherein said means for delivering said metered amount of said second fluid further comprises a means for preventing discharge of said first fluid into said cartridge housing when said selector valve is positioned to partially discharge to said inlet port.

7. The invention of claim 6 wherein said means for ensuring substantially complete emptying of said second fluid from said cartridge comprises a concave bottom on said housing whereby said means for delivery is extendable to the nadir of said concave bottom.

8. An interchangeable and disposable cartridge for use with a spray gun having a first fluid flow channel input conduit; a selector valve having a flow channel in fluid communication with said first fluid conduit, said valve having a second fluid inlet port in fluid communication with said flow channel; a second fluid discharge conduit for discharging a first discharge from said selector valve flow channel, said flow channel positionable to alternatively draw from said inlet port or partially discharge to said inlet port; a means for activating flow of a first fluid through said first fluid input conduit; and a means for discharging to the environment a discharge from said second fluid discharge conduit; said cartridge comprising:

a housing for containment of a second fluid within said cartridge;

a means for sealing engagement with said selector valve;

a means for delivery of a metered amount of said second fluid to said selector valve when said selector valve is positioned to draw from said cartridge, said means for delivery further preventing discharge of said first fluid into said cartridge housing when said selector valve is positioned to partially discharge to said inlet port.

9. The invention of claim 8 wherein said cartridge further comprises:

a means for ensuring substantially a complete emptying of said second fluid from said cartridge.

10. The invention of claim 9 wherein said means for sealing engagement of said cartridge with said selector valve is a bellows fitment.

11. The invention of claim 10 wherein said means for ensuring substantially complete emptying of said second fluid from said cartridge comprises a concave bottom on said housing whereby said means for delivery is extendable to the nadir of said concave bottom.

* * * * *